US009687100B2

(12) United States Patent
McMahan

(10) Patent No.: US 9,687,100 B2
(45) Date of Patent: Jun. 27, 2017

(54) MAT SYSTEMS AND METHODS

(71) Applicant: Robert L McMahan, Cedar Park, TX (US)

(72) Inventor: Robert L McMahan, Cedar Park, TX (US)

(73) Assignee: LET'S GEL INC., Austin, TX (US)

( * ) Notice: Subject to any disclaimer, the term of this patent is extended or adjusted under 35 U.S.C. 154(b) by 527 days.

(21) Appl. No.: 14/296,343

(22) Filed: Jun. 4, 2014

(65) Prior Publication Data

US 2015/0320247 A1 Nov. 12, 2015

Related U.S. Application Data

(60) Provisional application No. 61/989,740, filed on May 7, 2014.

(51) Int. Cl.

| | |
|---|---|
| ***A47G 27/02*** | (2006.01) |
| ***A47G 27/04*** | (2006.01) |
| ***A47G 9/06*** | (2006.01) |
| ***A63B 6/00*** | (2006.01) |
| *A63B 21/00* | (2006.01) |

(52) U.S. Cl.

CPC ..... *A47G 27/0231* (2013.01); *A47G 27/02* (2013.01); *A47G 27/0212* (2013.01); *A47G 27/0218* (2013.01); *A47G 27/0293* (2013.01); *A47G 27/04* (2013.01); *A47G 9/06* (2013.01); *A47G 9/062* (2013.01); *A63B 6/00* (2013.01); *A63B 21/4037* (2015.10); *Y10T 29/49828* (2015.01); *Y10T 428/24025* (2015.01); *Y10T 428/24942* (2015.01); *Y10T 428/249923* (2015.04)

(58) Field of Classification Search

CPC .. A47G 27/0218; A47G 27/0212; A47G 9/06; A47G 9/062; A47G 27/0231; A47G 27/0237; A47G 27/0293; A47G 27/04; A47G 27/02; Y10T 428/24025; Y10T 428/249923; Y10T 428/24942; Y10T 29/49828; A63B 21/4037; A63B 6/00

USPC ..... 5/417, 420; 29/429

See application file for complete search history.

(56) References Cited

U.S. PATENT DOCUMENTS

| | | | | |
|---|---|---|---|---|
| 2,931,685 | A * | 4/1960 | Myra | A47B 17/02 108/32 |
| 4,784,888 | A * | 11/1988 | Schwertner | A63B 6/00 428/130 |
| 5,088,421 | A * | 2/1992 | Beckstead | A47B 9/12 108/147 |
| 5,174,223 | A * | 12/1992 | Nagy | A47B 21/00 108/50.01 |
| 5,645,914 | A * | 7/1997 | Horowitz | A47G 27/0231 428/172 |
| 6,183,833 | B1 * | 2/2001 | Robbins, III | A47G 27/0206 428/156 |
| 6,284,341 | B1 * | 9/2001 | Robbins, III | A47G 27/0206 428/156 |

(Continued)

*Primary Examiner* — Christopher Besler
*Assistant Examiner* — Bayan Salone
(74) *Attorney, Agent, or Firm* — Pierson IP, PLLC

(57) ABSTRACT

Embodiments disclosed herein describe anti-fatigue mat systems and methods configured to provide a seamless transition between a first position allowing a user to sit on a chair positioned in front of a workstation and a second position allowing the user to stand on an upper mat positioned in front of the work station.

19 Claims, 7 Drawing Sheets

(56) References Cited

U.S. PATENT DOCUMENTS

| | | | | |
|---|---|---|---|---|
| 6,554,782 | B2 * | 4/2003 | Robbins, III | A47G 27/0206 428/120 |
| 6,579,250 | B2 * | 6/2003 | Robbins, III | A47G 27/0206 428/120 |
| 6,651,277 | B1 * | 11/2003 | Marson | A47C 27/084 5/420 |
| 6,851,141 | B2 * | 2/2005 | McMahan | A47G 27/0231 428/102 |
| 7,445,833 | B2 * | 11/2008 | Polley | A47G 27/0231 15/215 |
| 7,682,680 | B2 * | 3/2010 | McMahan | A47G 27/0231 428/102 |
| 7,754,127 | B2 * | 7/2010 | McMahan | A47G 27/0231 156/292 |
| 7,993,726 | B2 * | 8/2011 | Johnson | A47G 27/0231 15/215 |
| 8,034,274 | B1 * | 10/2011 | McMahan | A47G 27/0231 156/292 |
| 8,075,971 | B1 * | 12/2011 | Horian | B32B 3/08 428/61 |
| 9,445,681 | B2 * | 9/2016 | Robbins, III | A47G 27/0231 |
| 2003/0203164 | A1 * | 10/2003 | Healy | B32B 5/30 428/178 |
| 2004/0237194 | A1 * | 12/2004 | McMahan | A47G 27/0231 5/420 |
| 2012/0288663 | A1 * | 11/2012 | Sabry | A47G 27/0237 428/95 |

* cited by examiner

MAT SYSTEMS AND METHODS

CROSS-REFERENCE TO RELATED APPLICATIONS

This application claims a benefit of priority under 35 U.S.C. §119 to Provisional Application No. 61/989,740 filed on May 7, 2014, entitled "STAND-UP DESK ANTI-FATIGUE MAT SYSTEM," which is fully incorporated herein by reference in its entirety.

BACKGROUND INFORMATION

Field of the Disclosure

Examples of the present disclosure are related to a mat system configured to operate in multiple positions. More particularly, embodiments disclose a workstation that is configured to be transitioned between a sitting position and a standing position.

Background

A stand-up desk is a desk that allows a user to write, read, operate a keyboard, etc. while standing. Conventionally, stand-up desks have been made in many different styles or variations, where the height of the desk may be adjusted to fit the height of the user. Because a user operating stand-up desks is required to stand, the user may desire to stand on an anti-fatigue mat, which is designed to reduce the fatigue of the user working in the standing position for prolonged periods of time. Even with an anti-fatigue mat, it is difficult for a user to stand for an entire workday. Therefore, a user is typically required to alternate between utilizing a stand-up desk and a conventional sit-down desk throughout the workday.

For space efficiency purposes, workstations have been engineered that are configured to be converted between a stand-up desk and a sit-down desk. When a user is using a sit-down desk, the user usually sits on a chair that is positioned over a chair mat, wherein the chair mat covers and protects carpet or hardware flooring. However, when using a workstation it is inconvenient and difficult for a user to continuously move a chair mat and an anti-fatigue mat to be positioned in front of the workstation.

Accordingly, needs exist for more effective and efficient systems and methods for a workstation that is configured to transition between an anti-fatigue mat and chair mat being positioned in front of the workstation.

SUMMARY

Embodiments disclosed herein describe mat systems and methods configured to provide a seamless transition between a first position allowing a user to sit on a chair positioned in front of a workstation and a second position allowing the user to stand on an anti-fatigue mat positioned in front of the work station. Therefore, the anti-fatigue mat system may transform a hard standing surface positioned in front of the workstation into a cushioned, anti-fatigue standing surface, which may improve a user's comfort and productivity.

By utilizing an anti-fatigue mat system that operates in a plurality of positions, embodiments may incorporate style, comfort, ease of use, ease of clean-ability, durability, and utility. The anti-fatigue mat system may be implemented in office, residential, or commercial settings to conserve space and improve the efficiency of a workstation.

Embodiments may include an anti-fatigue mat system comprising a lower mat, a plate, and an upper mat. The lower mat may be configured to extend from a first position underneath a workstation to a second position in front of the workstation. The plate may be configured to move between the first position and the second position. The upper mat may be coupled to an upper surface on the plate, wherein the upper mat is softer than the lower mat.

Embodiments may include a first set of first coupling members positioned on the lower mat, wherein the first set of first coupling members are associated with the first position, and a second set of first coupling members positioned on the lower mat, wherein the second set of first coupling members are associated with the second position.

Embodiments may also include second coupling members positioned on a lower surface of the plate, wherein the second coupling members are configured to couple or interface with the first set of first coupling members and the second set of first coupling members. Responsive to the second coupling members interfacing with a set of first coupling members, the plate may be secured in place.

In embodiments, a spring may be positioned on the lower surface of the plate, wherein the spring is configured to raise the lower surface of the plate away from the lower mat. Thus, creating a lower friction for sliding the plate over the lower mat.

In embodiments, responsive to the second coupling members aligning with a set of first coupling members and the upper mat receiving force from a user greater than the force of the spring, the second coupling members will be inserted into the aligned set of first coupling members to couple the plate to the lower mat.

Embodiments may include a sliding track configured to guide the movement of the plate in a linear direction between the first position and the second position. The sliding track may include a horizontal rail, vertical rails, and a stop. The horizontal rail may be associated with the first position, wherein when the plate is positioned adjacent to the horizontal rail the upper mat may be in the first position. The vertical rails may be configured to guide the movement of the plate in the linear direction. The stop may be associated with the second position, wherein when the plate is positioned adjacent to the stop, the upper mat may be in the second position.

In embodiments, a length of the lower mat may be greater than the length of the plate and the upper mat.

In embodiments, the plate may be a bottom surface of the upper mat, and the plate may be fixedly and/or removably coupled to the upper mat.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
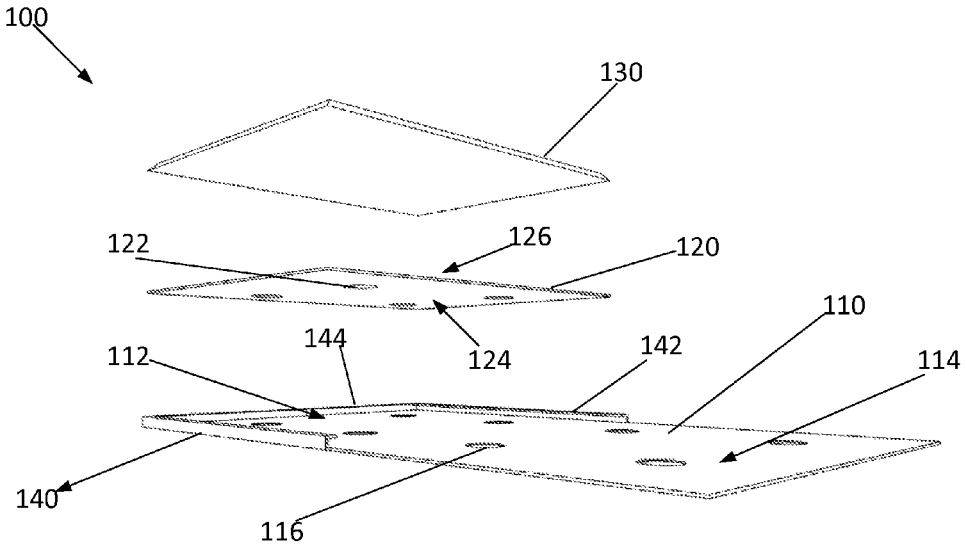
FIG. 1 depicts one embodiment of a topology for an anti-fatigue mat system.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe anti-fatigue mat systems and methods configured to provide a seamless transition between a first position allowing a user to sit on a chair positioned in front of a workstation and a second position allowing the user to stand on an upper mat positioned in front of the work station.

FIG. 1 depicts one embodiment of a topology for an anti-fatigue mat system 100. Anti-fatigue mat system 100 may include a lower mat 110, plate 120, upper mat 130, and sliding track 140.

Lower mat 110 may be a surface of anti-fatigue mat system 100 that is configured to be positioned adjacent to a floor, carpet, bottom, etc. to protect and/or cover the floor, carpet, bottom, etc. Lower mat 110 may be a hard, rigid surface, such as a plastic chair mat, wherein lower mat 110 may be configured to allow a chair with wheels to roll easily over lower mat 110. Lower mat 110 may have a first end 112, second end 114, and first coupling members 116.

First end 112 of lower mat 110 may be configured to be positioned underneath a desk, counter, workstation, etc. (referred to herein after individually and collectively as workstation). Second end 114 of lower mat 110 may be configured to be positioned in front of the workstation, wherein a chair may be positioned over second end 114 while a user is using the workstation.

First coupling members 116 may be depressions, indentations, grooves, orifices, etc. positioned on an upper surface of lower mat 110. In embodiments, a first set of first coupling members 116 may be positioned proximate to first end 112 of lower mat 110, and a second set of first coupling members 116 may be positioned proximate to second end 114 of lower mat 110.

Plate 120 may be a sheet, pane, panel, plate, etc. that is configured to slide or be moved along a linear axis. A first surface 124 of plate 120 may be comprised of a plurality of materials having a non-slip lower surface, which enables plate to be moved across a lower mat 110. First surface 124 of plate 120 may be configured to be positioned adjacent to lower mat 110, and a second surface 126 of plate 120 may be configured to be positioned adjacent to upper mat 130.

In embodiments, plate 120 may be configured to move between the first set of first coupling members 116 and the second set of first coupling members 116, wherein if plate 120 is interfaced with the first set of first coupling members 116 then plate 120 may be positioned in a first position (e.g. a storage position), and if plate 120 is interfaced with the second set of first coupling members 116 then plate 120 may be positioned in a second position (e.g. a usage position). Plate 120 may be configured to be moved between the first position to the second position in a plurality of different implementations, such as force generated from a user's foot, a motor, etc.

More specifically, first surface 124 of plate 120 may include a set of second coupling members 122, wherein the second coupling members 122 may be projections, protrusions, etc. configured to interface with corresponding first coupling members 116. In embodiments, if the set of second coupling members 122 are interfaced with a set of first coupling members 116, then plate 120 may be secured, immobilized, and/or restricted from moving. One skilled in the art will appreciate that first coupling members 116 and second coupling members 122 may be any implementation of a mating pair with first coupling members 116 being the female coupling portion and second coupling members 122 being the male coupling portion, or vice versa. In embodiments, if second coupling members 122 are decoupled from first coupling members 116, then the surface area of lower mat 110 covered by plate 120 may be less than the surface area of lower mat 110 covered by plate 120 when second coupling members 122 are coupled to a set of first coupling members 116.

Therefore, if second coupling members 122 are decoupled from first coupling members 116, then the surface area of lower mat 110 being covered by plate 120 may be only the bottom surface of second coupling members 122. Accordingly, if second coupling members 122 are decoupled from first coupling members 116, then the reduced, limited, or minimized surface area between lower mat 110 and plate 120 may allow plate 210 to be more easily moved between a first set of first coupling members 116 and a second set of first coupling members 116. Alternatively, if first coupling members 122 are coupled with first coupling members 116, then the surface area of lower mat 110 covered by plate may be the entire first surface 124 of plate 120. Thus, if second coupling members 122 are coupled to a set of first coupling members 116, then the increased, larger, and/or maximized surface area between lower mat 110 and plate 120 may restrict or limit the movement of plate 120.

Upper mat 130 may be a mat that is configured to reduce a user's fatigue, body stress, discomfort, etc. when the user is standing on upper mat 130. In embodiments, upper mat 130 may be an anti-fatigue mat, an anti-static mat, clean-room mat, peel of mat, sanitizing mat, anti-variation mat, etc. Upper mat 130 may be comprised of a plurality of different materials, which may form a softer surface than lower mat 110. Upper mat 130 may be configured to be permanently and/or removably coupled to second surface 126 of plate 120. Upper mat 130 may be configured to move corresponding to the movement of plate 120. Therefore, if plate 120 is coupled to the first set of first coupling members 116, then upper mat 130 may be positioned in the first position, and if plate 120 is coupled to the second set of first coupling members 116, then upper mat 130 may be positioned in the second position.

In embodiments, upper mat 130 may have a weight such that if plate 120 is aligned with a set of first coupling members 116 the weight will create a downward force to couple plate 120 with the set of first coupling members 116. In further embodiments, upper mat 130 may include a spring (not shown). The spring is configured to create a force to raise plate 120 away from lower mat 110 to decouple first coupling members 116 and second coupling members 122, and to reduce the surface area between plate 120 and lower mat 110. The spring may be compressed if the user applies downward force on an upper surface of upper mat 130 greater than the force of the spring, wherein if the user is not applying force to the upper surface of upper mat 130 the spring will decouple second coupling members 122 from a set of first coupling members 116. The spring may also be a constant force spring which the force the spring exerts over its range of motion is constant. The constant force spring may be constructed such that the spring is relaxed when the spring is fully rolled. As the spring is unrolled, the restoring force may come primarily from the portion of the ribbon near the roll, which the resulting force may be constant. Therefore, the constant force spring may be configured to continually apply a constant force between plate 120 and lower mat 110.

Sliding track 140 may be comprised of tracks, channels, groves, etc. configured to receive plate 120 and control the movement of plate 120 along a linear axis, wherein the linear axis may be parallel to a length of lower mat 110. In embodiments, sliding track 140 may be positioned at first end 112 of lower mat 110. Sliding track 140 may include vertical rails 142, a horizontal rail 142, and a stop.

Vertical rails 142 of sliding track 140 may extend from first end 112 of lower mat 110 towards second end 114 of lower mat 110, while horizontal rail 144 of sliding track may extend across first end 112 of lower mat 110. Vertical rails 142 may be configured to guide plate 120 along the linear axis, while horizontal rail 144 may be configured to limit the movement of plate 120 in a direction along the linear axis. In embodiments, if plate 120 is positioned adjacent to horizontal rail 144, then plate 120 may be in the first position. In embodiments, vertical rails 142 may have a projection, stop, etc., which may be positioned proximate to the end of a vertical rail 142 closest to second end 114 of lower mat 110. The stop may be configured to stop the movement of plate 120 towards second end 114, wherein if portions of plate 120 are positioned adjacent to the stop, then plate 120 may be in the second position.

In further embodiments, anti-fatigue mat system 100 may include a foot interface, which may be a heel indent, loop of fabric, etc., positioned on plate 120 and/or upper mat 130, wherein the foot interface may be configured to receive a user's foot. Utilizing the foot interface, a user may place their foot within the interface, apply vertical force to lift the second coupling members 122 to decouple plate 120 from lower mat 110, and apply horizontal force to move plate 120 between the first position and second position. In implementations utilizing a motor, responsive to the user performing actions to initiate the motor, the motor may be configured decouple plate 120 and lower mat 110, and to move plate 120 between the first position and the second position.

Figure 2:
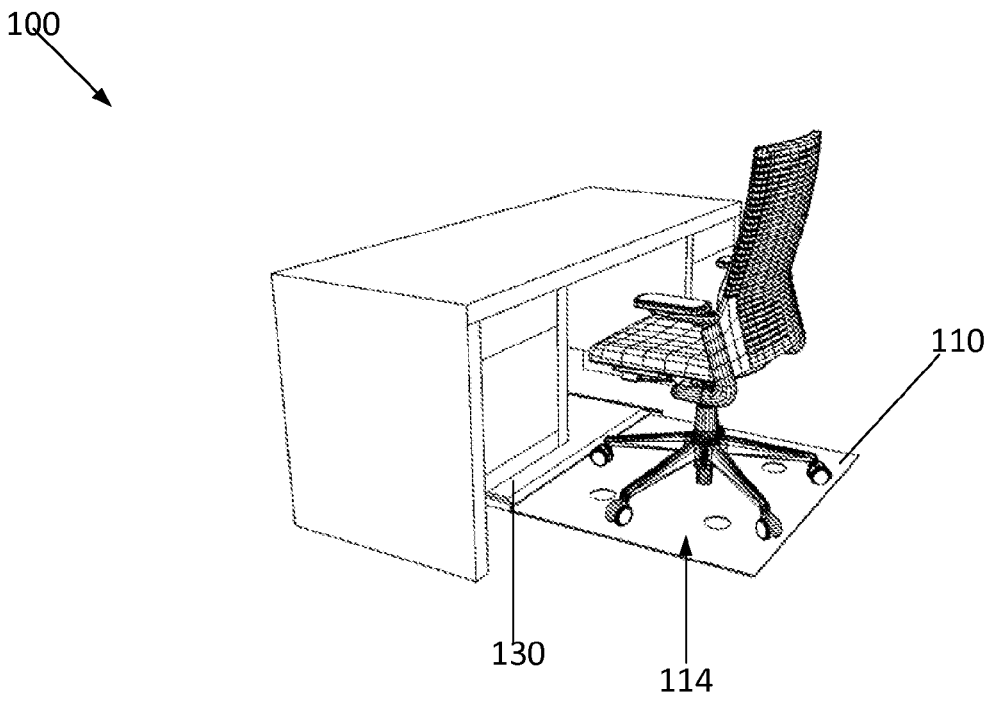
FIG. 2 depicts one embodiment of an anti-fatigue mat system in the first position.

FIG. 2 depicts one embodiment of anti-fatigue mat system 100 in the first position. As depicted in FIG. 2, plate 120 and upper mat 130 may be positioned towards first end 112 of lower mat 110, which may position plate 120 and upper mat 130 under workstation 200. When plate 120 and upper mat 130 are in the first position, second end 114 of lower mat 110 may be exposed, which may allow a chair to easily and efficiently move on lower mat 110.

Furthermore, responsive to upper mat 130 being in the first position and under workstation 200, upper mat 130 may be configured to be a foot rest. While upper mat 130 is in the first position, the top surface of upper mat 130 may be positioned or angled to receive a user's feet, wherein the user may comfortably place their feet.

Figure 3:
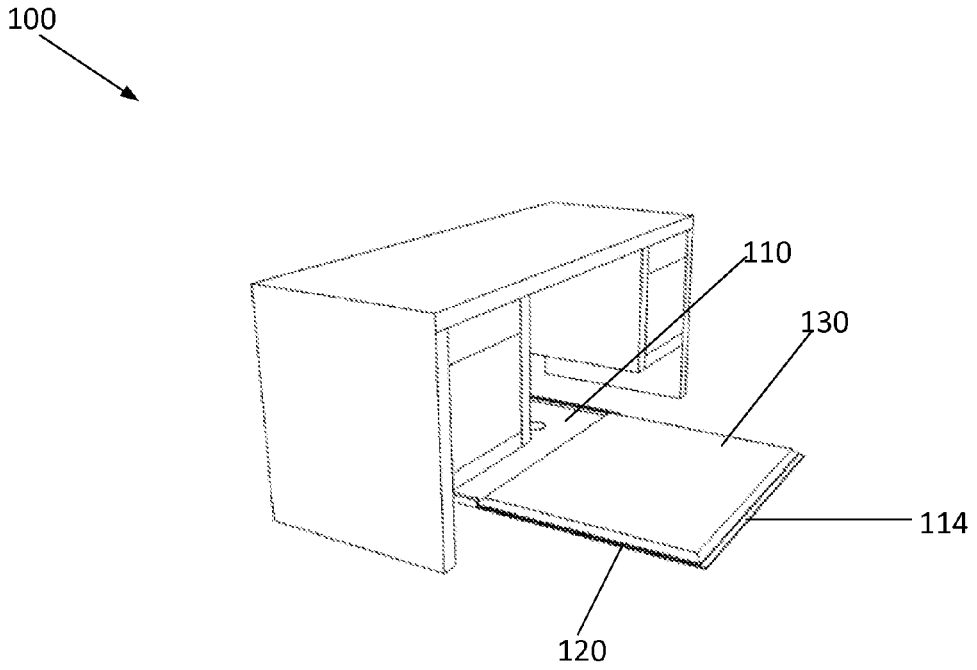
FIG. 3 depicts one embodiment of an anti-fatigue mat system in the second position.

FIG. 3 depicts one embodiment of anti-fatigue mat system 100 in the second position. As depicted in FIG. 3, plate 120 and upper mat 130 may be positioned towards second end 114 of lower mat 110, which may position plate 120 and upper mat 130 in front of workstation 200. When plate 120 and upper mat 130 are in the second position, second end 114 of lower mat 110 may be covered by plate 120 and upper mat 130, which may allow a user to comfortably stand on upper mat 130.

Figure 4:
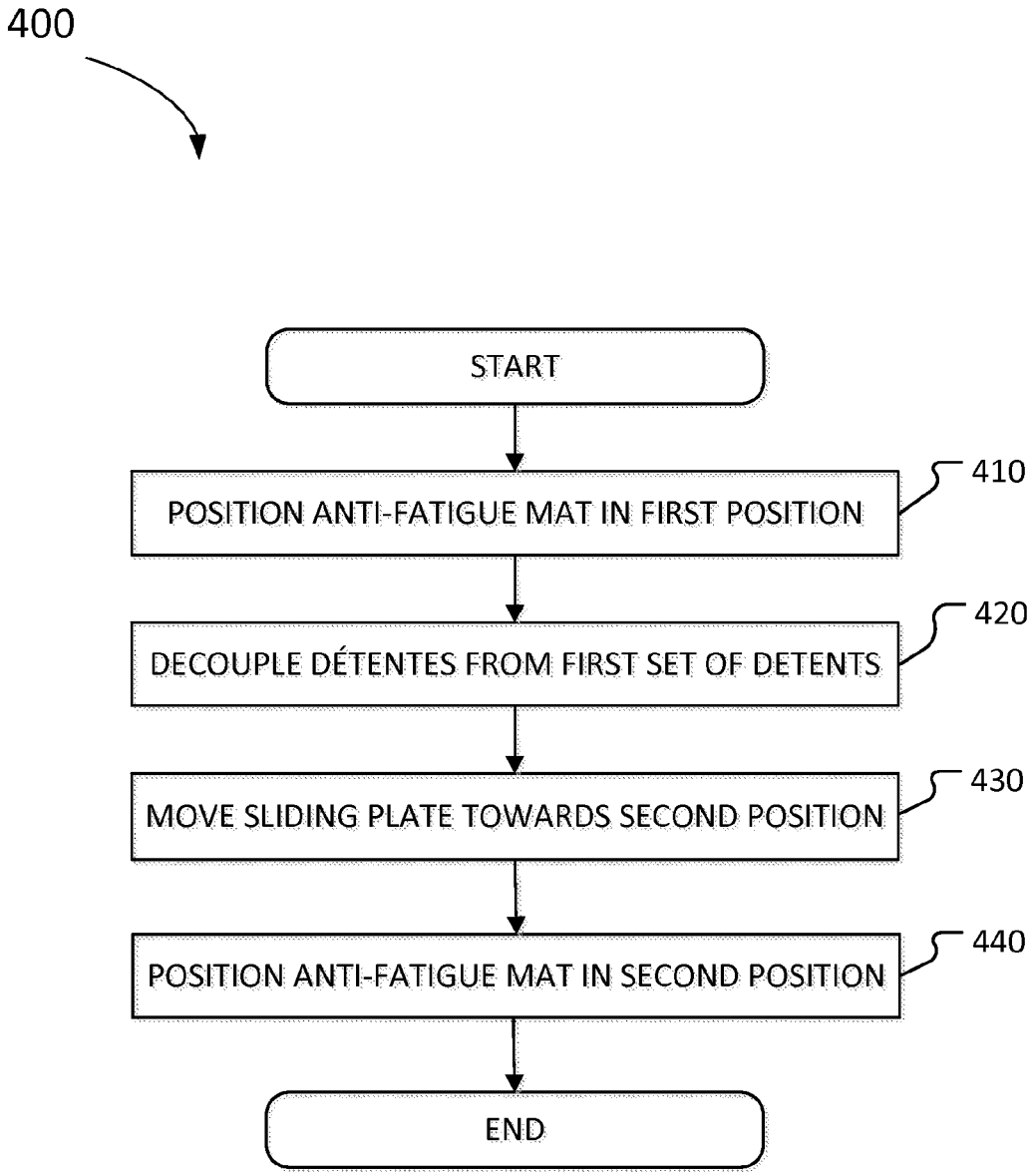
FIG. 4 depicts one embodiment of a method for moving an anti-fatigue mat system between a first position and a second position.

FIG. 4 depicts a method 400 for moving an anti-fatigue mat system between a first position and a second position. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, second coupling members associated with a plate may be coupled with a first set of first coupling members associated with a lower mat to position an upper mat in a first position. When the upper mat is in the first position, the upper mat may be positioned underneath a workstation and proximate to a first end of the lower mat, which may conserve space while allowing an upper portion of a lower mat positioned in front of the work station to be exposed. A user may desire to place and move a chair on the upper portion of the lower mat that is exposed in front of the work station.

At operation 420, the second coupling members associated with the plate may be decoupled from the first set of first coupling members associated with the lower surface. The second coupling members may be decoupled from the first coupling members in a plurality of different ways, including raising and moving the plate away from the first set of second coupling members. Responsive to decoupling the second coupling members from the first set of first coupling members, the surface area of the plate positioned adjacent to the lower mat may be reduced, wherein only a bottom surface of the second coupling members may contact the lower surface.

At operation 430, the plate may be moved from the first position towards the second position. By limiting the surface area of the plate contacting the lower surface, the plate may be more efficiently moved along a linear axis towards the second end of the lower surface.

At operation 440, the second coupling members associated with the plate may be coupled with a second set of first coupling members associated with the lower mat to position the upper mat in the second position. When the upper mat is in the second position, the upper mat may be positioned in front of the workstation and proximate to the second end of the lower surface. Therefore, the user may be able to stand on the upper mat to reduce or lower the user's fatigue while standing in front of the workstation.

Figure 5:
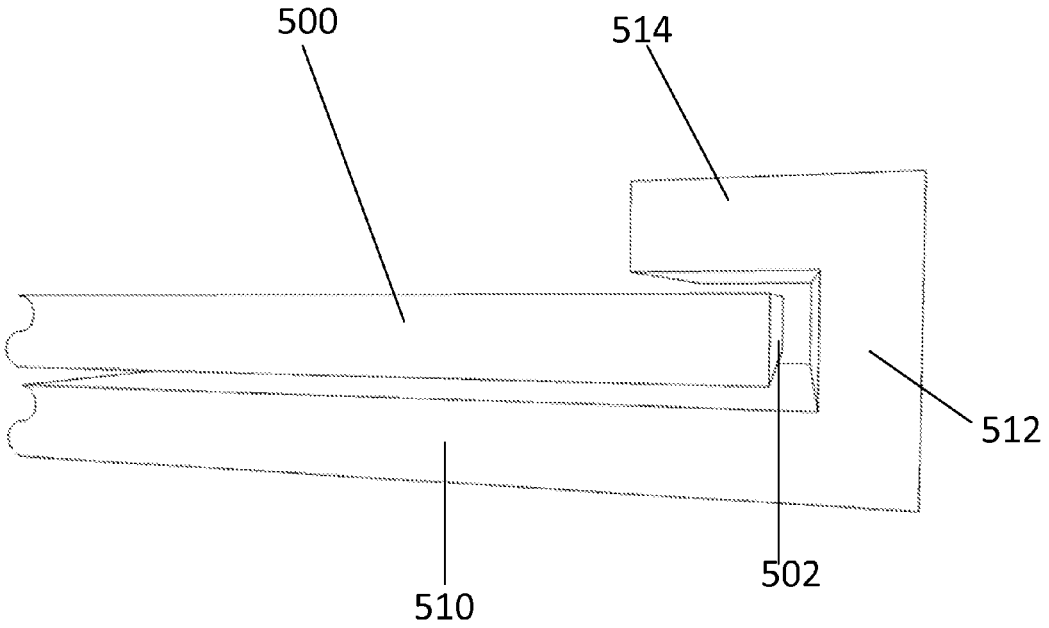
FIG. 5 depicts one embodiment of a plate and sliding track.

FIG. 5 depicts one embodiment of plate 500 and sliding track 510. As depicted in FIG. 5, an outer surface of plate 500 may be positioned adjacent to a rail 512 of sliding track 510. Furthermore, sliding track 510 may include an overhang 514, wherein overhang 514 may be configured to limit the vertical movement of plate 500. In embodiments, rail 512 may be positioned such that there is a slight gap, partition, space, etc. between a sidewall 502 of plate 500 and rail 512, such that the movement of plate 500 may be restricted to a linear path.

Additionally, in further embodiments, an upper mat (not shown) may be positioned adjacent to an inner sidewall of rail 512 when the upper mat is in the first position. As such, plate 500 has a surface extending across the entire surface of the upper mat, and the sliding track 510 may have a surface extending across the entire surface of plate 500.

Figure 6:
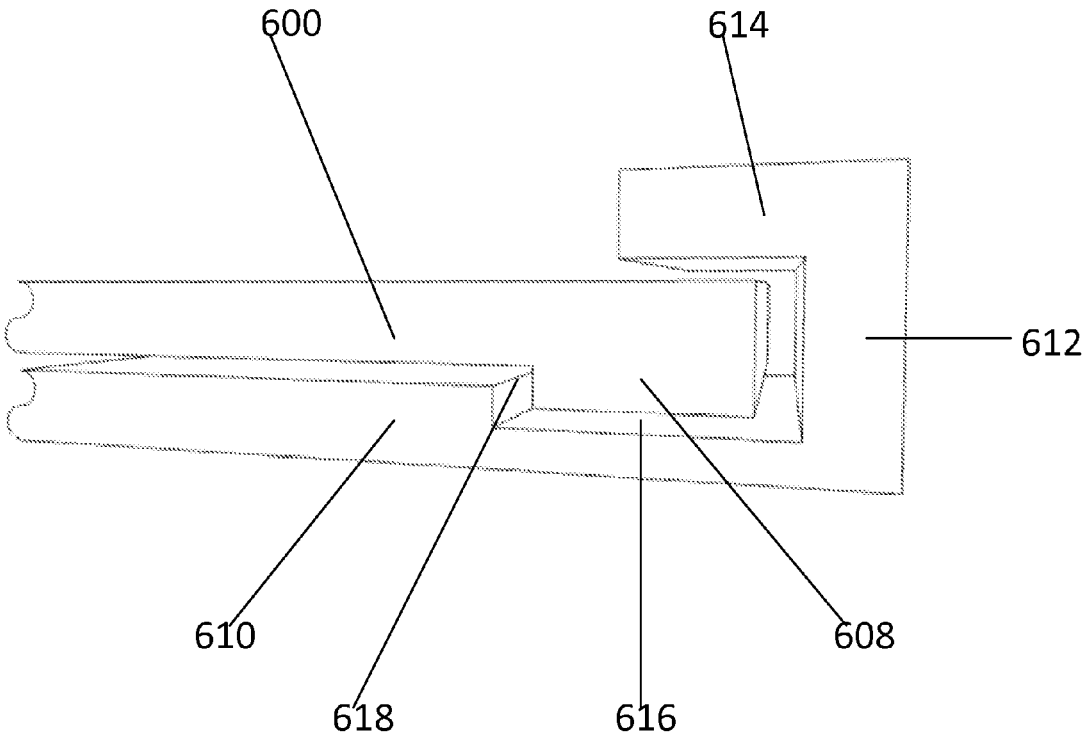
FIG. 6 depicts one embodiment of a plate and sliding track.

FIG. 6 depicts one embodiment of plate 600 and sliding track 610. As depicted in FIG. 6, sliding track 610 may have a depression, groove, and/or channel (referred to herein after individually and collectively as "depression 616"), wherein depression 616 may be positioned adjacent to rail 612. Plate 600 may include a projection 608 which is configured to be positioned within depression 616 to secure plate within sliding track 610. Responsive to projection 608 being positioned within depression 616, the movement of sliding track may be limited and/or impeded by sidewall 618 associated with the depression, rail 612, and/or overhang 614.

Figure 7:
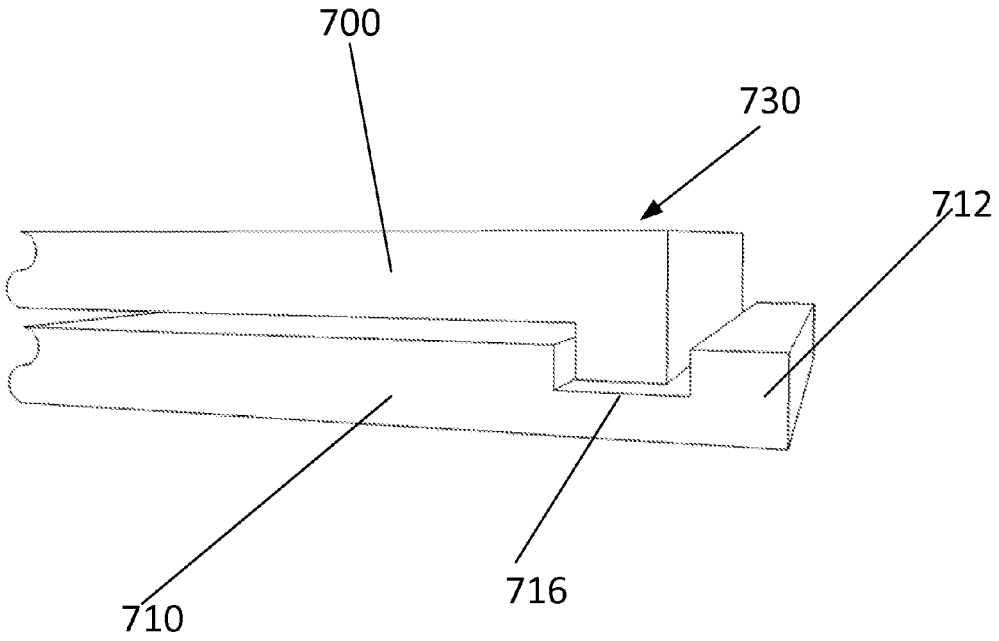
FIG. 7 depicts one embodiment of a plate and sliding track.

FIG. 7 depicts one embodiment of plate 700 and sliding track 710. As depicted in FIG. 7, sliding track 710 may have a depression 716 and a rail 712, wherein a height of rail 712 does not extend past a top surface 730 of plate 700. By utilizing a sliding track 710 that does not include an overhang and/or a rail 712 having a height greater than the height of plate 700, plate 700 may be easily decoupled from sliding track 710.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A mat system comprising:

a lower mat configured to extend from a first position underneath a workstation to a second position in front of the workstation;

a plate configured to move between the first position and the second position; and an upper mat being coupled to an upper surface on the plate, the upper mat being comprised of a softer material than the lower mat;

a sliding track configured to guide the movement of the plate in a linear direction between the first position and the second position.

2. A mat system comprising:

a lower mat configured to extend from a first position underneath a workstation to a second position in front of the workstation;

a plate configured to move between the first position and the second position; and an upper mat being coupled to an upper surface on the plate, the upper mat being comprised of a softer material than the lower mat;

a first set of first coupling members positioned on the lower mat, wherein the first set of first coupling members are associated with the first position;

a second set of first coupling members positioned on the lower mat, wherein the second set of first coupling members are associated with the second position; and second coupling members positioned on a lower surface of the plate, wherein the second coupling members are configured to couple with the first set of first coupling members and the second set of first coupling members to secure the plate.

3. The system of claim 2, further comprising:

a spring positioned on the lower surface of the plate configured to raise the lower surface of the plate away from the lower mat.

4. The system of claim 3, wherein responsive to the second coupling members aligning with at least one of the first set of first coupling members and the second set of first coupling members and the upper mat receiving force from a user greater than the force of the spring, the second coupling members will couple with the at least one of the first set of first coupling members and the second set of first coupling members.

5. The system of claim 2, wherein the plate is a bottom surface of the upper mat.

6. The system of claim 1, wherein the sliding track includes:

a horizontal rail associated with the first position, wherein when the plate is positioned adjacent to the horizontal rail the upper mat will be in the first position;

vertical rails configured to guide the movement of the plate in the linear direction; and a stop associated with the second position, wherein when the plate is positioned adjacent to the stop the upper mat will be in the second position.

7. The system of claim 1, wherein a length of the lower mat is greater than the length of the plate or the upper mat.

8. The system of claim 1, wherein the plate is a bottom surface of the upper mat.

9. The system of claim 1, wherein the lower mat is configured to be positioned on a floor or carpet, and is configured to allow a chair with wheels to roll across an exposed portion of the lower mat not covered by the upper mat responsive to the upper mat being in the first position, wherein when the upper mat is in the first position the upper mat is configured to be a foot rest.

10. The system of claim 1, wherein responsive to the upper mat being in the second position, the upper mat covers a portion of the lower mat in front of the workstation, and the upper mat being configured to allow a user to stand on the upper mat.

11. A method of utilizing a mat system, the method comprising:

moving a plate between a first position of a lower mat and a second position of the lower mat, wherein the first position is underneath a workstation and the second position is in front of the workstation; and coupling an upper mat to an upper surface of the plate, the upper mat being comprised of a softer material than the lower mat, wherein movement of the upper mat corresponds to movement of the plate;

guiding the movement of the plate via a sliding track in a linear direction between the first position and the second position.

12. The method of claim 11, further comprising:

coupling second coupling members positioned on a lower surface of the plate with at least one of a first set of first coupling members positioned on the lower mat and a second set of first coupling members positioned on the lower mat, wherein the first set of first coupling members are associated with the first position and the second set of first coupling members are associated with the second position.

13. The method of claim 12, further comprising:

raising the lower surface of the plate away from the lower mat via a spring positioned on the lower surface of the plate.

14. The method of claim 13, further comprising:

aligning the second coupling members with at least one of the first set of first coupling members and the second set of first coupling members;

receiving force, by the upper mat, from a user greater than the force of the spring; and coupling the second coupling members with the alighted at least one of the first set of first coupling members and the second set of first coupling members.

15. The method of claim 11, wherein the plate is a bottom surface of the upper mat.

16. The method of claim 11, wherein the sliding track includes:

a horizontal rail associated with the first position, wherein when the plate is positioned adjacent to the horizontal rail the upper mat will be in the first position;

vertical rails configured to guide the movement of the plate in the linear direction; and a stop associated with the second position, wherein when the plate is positioned adjacent to the stop the upper mat will be in the second position.

17. The method of claim 11, wherein a length of the lower mat is greater than the length of the plate or the upper mat.

18. The method of claim 11, further comprising:

exposing a portion of the lower mat not covered by the upper mat responsive to the upper mat being in the first position, wherein a chair with wheels may roll across the exposed portion of the lower mat wherein when the upper mat is in the first position the upper mat is configured to be a foot rest.

19. The method of claim 11, further comprising:

covering a portion of the lower mat in front of the workstation with the upper mat responsive to the upper mat being in the second position; and allowing a user to stand on the upper mat.

* * * * *